US006012165A

United States Patent [19]

Cain

[11] Patent Number: 6,012,165

[45] Date of Patent: Jan. 11, 2000

[54] THUMB GUARD FOR CARPENTERS

[76] Inventor: Jeffrey G. Cain, P.O. Box 327, Antioch, Calif. 94509

[21] Appl. No.: 09/246,122

[22] Filed: Feb. 8, 1999

[51] Int. Cl.[7] ..... A41D 13/00

[52] U.S. Cl. ..... 2/21; 172/370; 15/236.01

[58] Field of Search ..... 2/21, 159, 161.6, 2/163, 167; 223/101; 602/22; 172/370; 132/73, 285, 319; 294/25; 15/236.01

[56] References Cited

U.S. PATENT DOCUMENTS

| | | | |
|---|---|---|---|
| D. 335,938 | 5/1993 | Kam . | |
| 549,229 | 11/1895 | Connelly . | |
| 1,306,442 | 6/1919 | Santotta . | |
| 1,316,292 | 9/1919 | Fleming | 2/21 |
| 1,388,618 | 8/1921 | Stein | 2/21 |
| 1,516,385 | 11/1924 | Keck . | |
| 2,070,506 | 2/1937 | Bevill . | |
| 2,348,962 | 5/1944 | Davis . | |
| 2,467,613 | 4/1949 | Davis | 2/21 |
| 2,925,605 | 2/1960 | Wheeler | 2/21 |
| 3,728,736 | 4/1973 | Pugh . | |
| 4,796,302 | 1/1989 | Davis et al. . | |
| 4,867,246 | 9/1989 | Kiger | 172/370 |
| 4,908,881 | 3/1990 | Field | 2/163 |
| 5,234,142 | 8/1993 | Loewen et al. | 223/101 |
| 5,282,276 | 2/1994 | Preziose | 2/21 |
| 5,517,692 | 5/1996 | Wunderlich-Kehm | 132/73 |
| 5,647,063 | 7/1997 | Bates | 223/101 |
| 5,699,816 | 12/1997 | Banes et al. | 132/285 |

FOREIGN PATENT DOCUMENTS

| | | |
|---|---|---|
| 48610 | 10/1986 | Australia . |
| 173536 | 2/1935 | Switzerland . |
| 1607767 | 11/1990 | U.S.S.R. . |
| 189759 | 5/1923 | United Kingdom . |

*Primary Examiner*—Tejash D Patel
*Attorney, Agent, or Firm*—Richard C. Litman

[57] ABSTRACT

A thumb protector for use in carpentry, made of metal or a durable composite material of sufficient strength to protect a human thumb from a hammer blow. A cloth fastening jacket and associated fastening band encircling the second phalanx of the thumb firmly secure the protector to the first phalanx. The portion of the sheath covering the thumbpad has an arcuate groove disposed transversely relative to the thumb enabling the wearer to roll a nail into position between thumb and forefinger from a reservoir located in the palm of the same hand. The grooves pass completely through the material of the protector and so also allow the thumb to breathe. Integrally attached to the sheath is an extrusion which functionally and structurally mimics a human thumbnail.

7 Claims, 3 Drawing Sheets

THUMB GUARD FOR CARPENTERS

BACKGROUND OF THE INVENTION

1. Field of the Invention

The present invention relates to finger protectors and, more specifically, to thumb protectors for use in carpentry.

2. Description of Related Art

Those practiced in the art of carpentry will readily acknowledge that a need exists for a device which protects the thumb against errant hammer blows in the course of setting and hammering nails. In order to be fully effective as a carpenter's utility item, however, such a device must meet a number of secondary needs as well. The first of these secondary needs emerges as an immediate corollary of the basic protective function. In order to best accomplish its protective aim, the device in question must be reliably secured to the thumb with some fastening means. Otherwise it will be liable to slip off during use.

A further need that such a device must fulfill arises due to a common practice among carpenters known as "rolling nails," a one-handed process used to set nails. It involves using the thumb of the setting hand first to retrieve individual nails from a reservoir located in the palm of the same hand, and then to roll them into position from the palm to a location between the thumb and forefinger of that hand. In the absence of the inclusion of suitable means enabling this practice, a protective device of the sort discussed here will preclude the performance of this task. Consequently, a device which protects the thumb from errant hammer blows must include a feature which enables and facilitates the process of rolling nails.

An additional need that a protective device of the aforementioned type must fulfill to be a genuinely effective carpenter's utility is to maintain the feel and sensitivity of a natural thumb. Specifically, the device must enable the wearer to mimic all the functions of a naked thumbnail insofar as the latter is useful for accomplishing a wide variety of tasks in carpentry, such as opening wrappers, turning small screws, marking a measurement, and scratching an itch. Moreover, the protective device and associated fastener must permit the joints in the thumb to be as flexible as they are in the absence of the device. Furthermore, the device must be equipped with ventilation means which enable the thumb to breathe and prevent it from becoming sweaty and overheated.

Many devices for the purpose of protecting the thumb and other fingers from accidental injury arising from hammer blows during carpentry as well as from a variety of other causes have been proposed in the past. U.S. Pat. No. 549,22309, issued to Connelly, discloses a finger shield adapted for use during sewing to protect the thumb from accidental needle piercing. U.S. Pat. No. 1,306,442, issued to Sansotta, discloses leather protectors of both the thumb and forefinger, each of which includes an adjustable strap to secure the device to the associated digit. U.S. Pat. No. 1,516,385, issued to Keck, discloses a thumb guard fully enclosing the first phalanx of the thumb and designed to prevent the thumb from being cut accidentally during the paring of fruit or vegetables. U.S. Pat. No. 2,070,506, issued to Bevill, discloses a thumb shield also designed to prevent injury during paring, but covering only the thumbpad portion of the thumb. Swiss Patent No. 173,536, issued on Feb. 16, 1935, discloses a partially enclosing thumbshield bearing strong similarities in structure and function to the one immediately aforementioned. Another fully enclosing thumbguard for use during paring, and outfitted with ridges on its thumbpad portion to facilitate gripping of the fruit or vegetable being pared, is disclosed in U.S. Pat. No. 3,728,736, issued to Pugh. Soviet Patent No. 1607767, issued on Oct. 19, 1973, discloses another protective device for use during paring which is distinguished by the fact that it encloses both phalanxes of the thumb. None of the aforementioned devices, however, possesses the strength and resiliency to provide effective protection against the impact of an errant hammer blow.

The following patents disclose protective devices which are specifically intended to protect against errant hammer blows. U.S. Pat. No. 1,316,292, issued to Fleming, discloses metal finger armor covering both the thumb and the forefinger. Each piece of armor is secured to its respective digit by means of a pivotal connection to a leather band encircling the user's wrist. The armor elements in question each include an aperture exposing the pad of the thumb and forefinger, respectively. The pivotal attachment means on this device inhibits the process of "rolling nails," however. Moreover, the device has the added disadvantage of greatly constraining the wearer's hand.

U.S. Pat. No. 2,348,962, issued to Davis, discloses a finger protector having tabs and slots on the inner side of the finger tip area adapted to grip a nail. The nail to be set and hammered may be rolled into position at the location of the holding tabs and slots from the palm of the same hand by means of the thumb. This device is specifically designed for fingers rather than thumbs, however, and leaves the thumb unprotected.

U.S. Pat. No. 4,746,302, issued to Davis et al., discloses a device designed to protect both the thumb and forefinger consisting of a pair of sheaths pivotally hinged towards each other. The sheaths have depressions on the inner sides thereof to grip a nail. The structure of the invention renders impossible the process of "rolling nails" from the palm into the set position, however, and the user's other hand must consequently be employed to accomplish this transfer. In addition, the device greatly constrains the flexibility of the user's hand.

Finally, U.S. Des. Pat. No. 335,938 discloses an ornamental design for a finger protector. No provision is included, however, to fasten the protector to the associated finger. Moreover, no means are provided with the device to enable the one-handed process of "rolling nails." Furthermore, the profusion of widened slots included with the device, presumably for decorative reasons, raises serious questions about the degree of protection it is able to provide against errant hammer blows.

In addition to the deficiencies attaching individually to the aforementioned arrangements for providing protection from errant hammer blows, none of the devices mentioned include a feature enabling the wearer to mimic the functions of the natural thumbnail relevant for carpentry.

The present invention supersedes all the aforementioned devices in that it uniquely incorporates a combination of structural features enabling it to effectively fulfill all the needs detailed above. Therefore, none of the above inventions and patents, taken either singly or in combination, is seen to describe the present invention as claimed.

SUMMARY OF THE INVENTION

The present device accomplishes the primary goal of protecting the user's thumb from errant hammer blows by means of a sheath fabricated from tempered steel or a suitable composite material which fully encloses the first phalanx of the thumb. It accomplishes the secondary goal of ensuring that the protective sheath remains securely attached to the user's thumb by the addition of a jacket made of nylon or other suitable material which circumferentially depends from the open end of the protective sheath so as to encircle the second phalanx of the thumb. Sewn onto this jacket is a hook-and-loop fastening strap which is used to tighten the jacket to the thumb. The jacket is permanently attached to the main body of the device by means including, but not limited to, hot glue or cinching.

The goal of enabling and facilitating the one-handed process of "rolling nails" is accomplished by the inclusion of at least one arcuate slot located on the thumbpad portion of the protective sheath and oriented transversely relative to the direction of the thumb. Not only does the presence of the slots enable and facilitate the process of "rolling nails" under ordinary conditions, but it enables the user to wear work gloves without thereby losing the ability to handle nails in this manner, as would be the case in the absence of the present invention. In the event that gloves are worn, the thumbguard is to be worn over the thumb-sheathing portion of the glove. The presence of the aforementioned slots has been shown to facilitate the one handed nail rolling process to such a degree that even persons who ordinarily lack the skill may successfully employ it.

Finally, the present invention effectively accomplishes all the needs heretofore described while maintaining a level of sensitivity and flexibility approximating that of the naked thumb. This is enabled first by an extrusion on the posterior side of the device which is meant to mimic the contours and, more importantly, the functional usefulness of a thumbnail. This aspect of the invention constitutes a considerable added convenience, since one encounters a wide variety of minor tasks in the course of carpentry to which this feature lends itself, such as opening wrappers, turning small screws, marking a measurement, and scratching an itch. Again, this feature is especially useful to those who generally wear gloves while doing carpentry, since it affords them the effective use of a bodily member not otherwise available to them. Second, the fastening means included with the present device includes slots at key location to render the joint of the thumb as mobile as it is in the absence of the thumb guard. Third, the slot or slots provided to enable the rolling of nails also exercises a ventilating function. A series of small apertures may be added as well to the side of the protective sheath which shields the thumbnail in order to provide further ventilation.

In summary, the present invention is distinguished from other devices in the prior art by its singular ability to protect securely from errant hammer blows without deforming or slipping, while at the same time enabling and facilitating the process of one-handedly transferring nails from a palm-held supply to a set position, and while also minimizing the loss of natural flexibility and sensitivity.

Accordingly, it is a principal object of the present invention to protect the thumb from errant hammer blows in the course of setting and driving nails.

It is another object of the invention to provide a thumb guard which will remain securely fastened to the user's thumb.

It is a further object of the invention to enable and facilitate the process of setting a single nail from a supply held in the palm of the same hand on which the thumb guard is worn using the thumb of that hand.

Still another object of the invention to provide a protective thumb guard having a feature which is structurally and functionally similar to the thumb nail of its user.

Still a further object of the invention is to provide a protective thumbguard which does not impede the natural flexibility of the thumb.

Yet another object of the invention is to provide ventilation allowing the thumb to breathe and preventing it from overheating.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
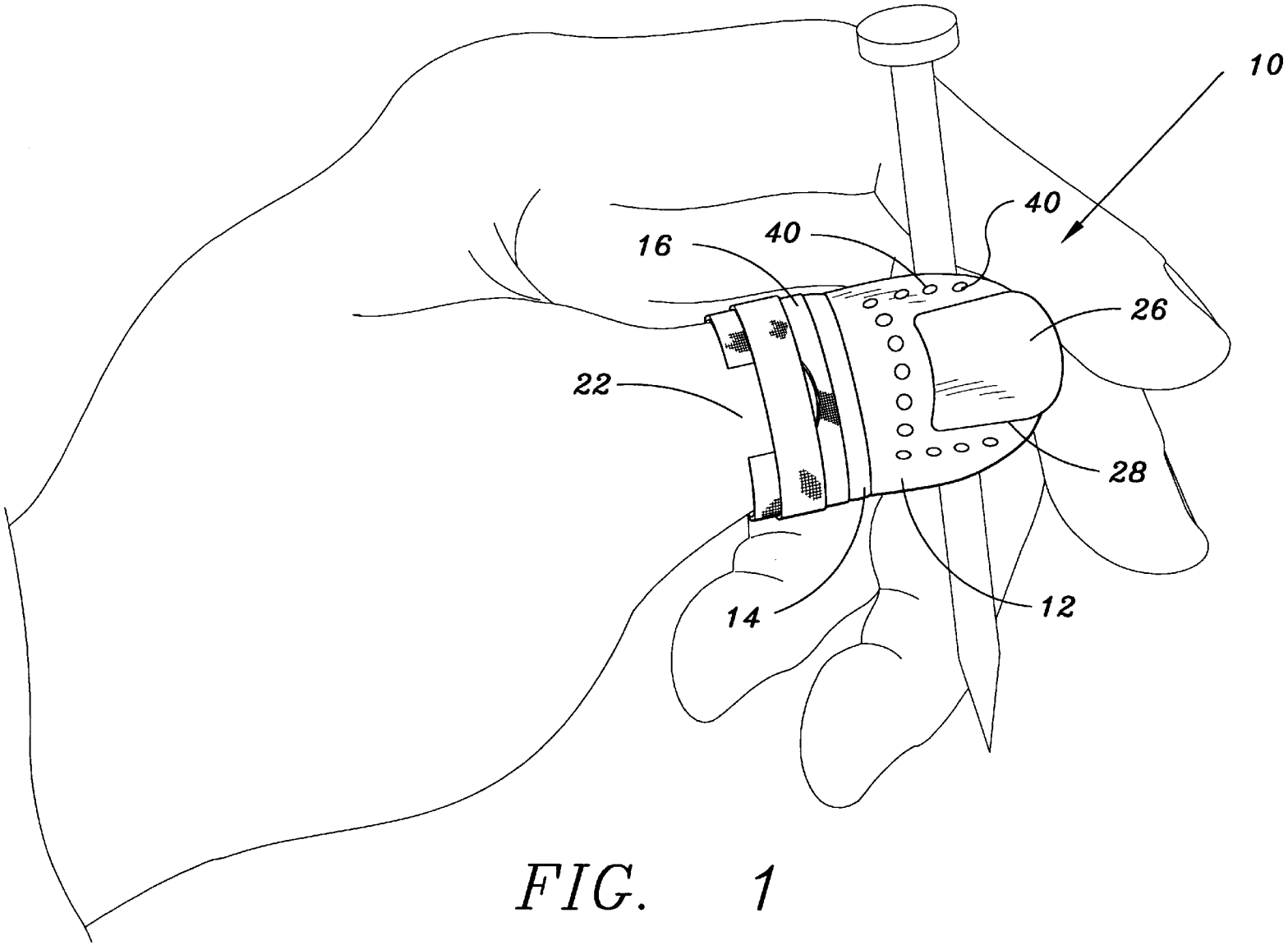
FIG. 1 is an environmental perspective view of the present invention showing it in use.

The drawings illustrate a thumb protector, designated by the general reference numeral 10, the primary component of which is a sheath 12 made of tempered steel or heavy duty composite that is strong enough to withstand a direct hammer blow. The sheath 12 is defined by a first side 17 and a second side 18. The first side 17 is for covering the side of a thumb having the thumbpad, while the second side 18 is for covering the side of a thumb having a thumbnail. The contours of the sheath allow it to fit closely over the user's thumb from the tip to a point approximately even with the first joint. The open end of the sheath terminates in a flanged section 14 which permits a fastening jacket 16 to be circumferentially attached.

In the preferred embodiment, the fastening jacket 16 is a single piece of nylon having an approximately cylindrical shape. The jacket is circumferentially secured to the flange section 14 of the protective sheath. Preferably its basically cylindrical shape is modified slightly in that the diameter of the jacket tapers inward as one approaches the second joint of the thumb. In this way, the contours of the fastening jacket 16 are in accord with the natural tendency of the second phalanx of the thumb to be of a smaller circumference than either the first or second joint. The jacket 16 covers the side of the second phalanx adjacent to the thumbpad and an opposite side of the second phalanx behind the thumbnail.

A number of methods are available whereby the jacket 16 may be affixed to the flanged section. First, the jacket 16 may be hot-glued to the inner rim (not shown) of the flanged section 14. Alternatively, the jacket 16 may be cinched in place by providing the protective sheath 12 with two co-axial flange rings 14, the outer of which is pressed against the inner one (not shown in the drawings) with the edge of the jacket 16 therebetween.

Figure 4:
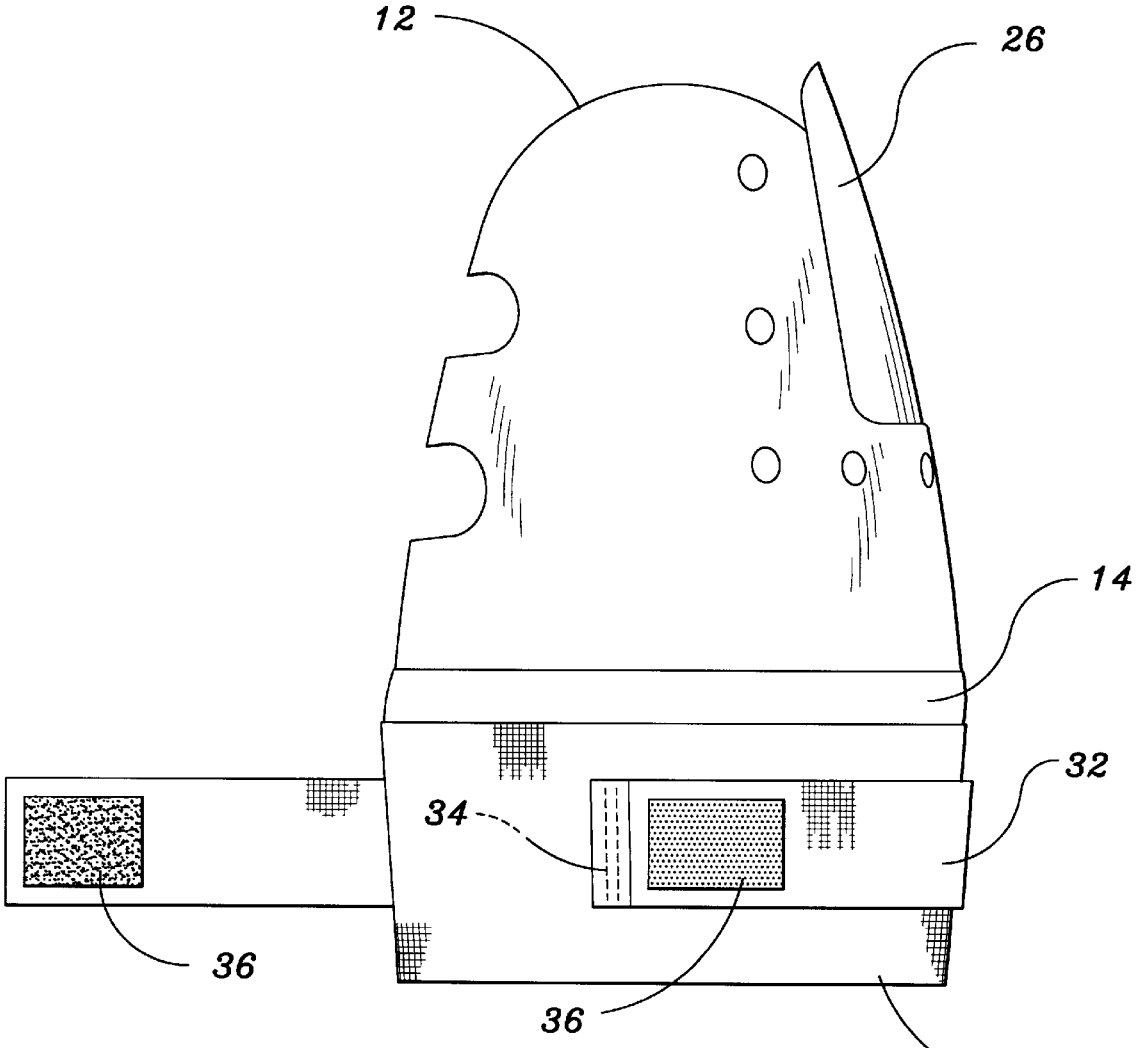
FIG. 4 is a side elevational view of the present invention.

Referring especially to FIG. 4, a fastening band 32 is affixed to the jacket 16 so as to encircle it. In the preferred embodiment, the fastening band 32 is sewn onto the cloth jacket at location 34, which allows it to circumferentially enclose the jacket 16 around the second phalanx of the thumb so as to hold the protective sheath 12 firmly in position. Mating strips of hook-and-loop fastening material 36 are affixed on appropriate locations on the fastening band 32, permitting it to be adjusted to fit comfortably.

Figure 2:
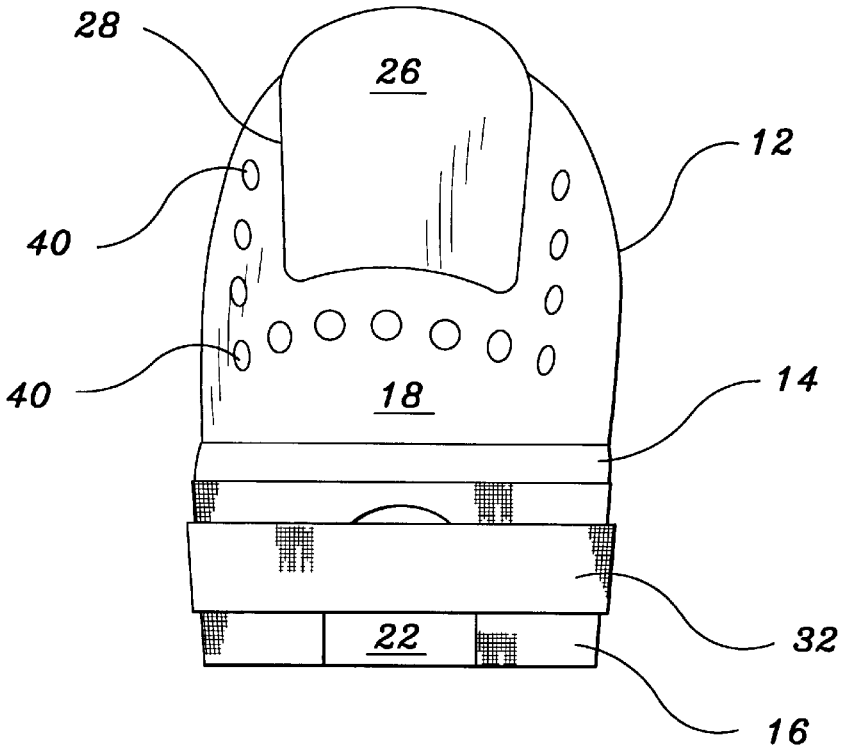
FIG. 2 is an elevational view of the front side of the present invention, i.e., the side which rests adjacent the knuckles of the thumb.

In order to retain maximal thumb flexibility, of the fastening jacket 16 includes at the open end a cutout portion 22 having approximately semi-circular shape proximate the second side 18 of sheath 12, as shown in FIGS. 1 and 2. This cutout portion 22 is intended to allow the first joint of the thumb to flex freely by permitting the second phalanx of the thumb some rearward play when the first joint of the thumb is bent. A smaller, slotted cutout portion 24 in the fastening jacket 16, shown in FIG. 3, is located adjacent flanged section 14 proximate the first side 17 of sheath 12 so as to accommodate the compression caused when the first joint of the thumb flexes inward.

As shown especially in FIGS. 1 and 2, the second side 18 of the sheath further includes an extrusion 26 formed by a molded extension, designed to functionally mimic a thumbnail. The imitation may also be rendered cosmetic by the addition of a shallow groove 28 in the sheath which imitates the contours of a thumbnail. The function of this extrusion 26 is to perform various prying and scraping actions commonly performed through the use of one's thumbnail. Performing these same actions with the extrusion confers the added advantage of sparing the thumbnail itself from injuries that may occur when performing minor tasks such as opening wrappers or turning small screws.

Figure 3:
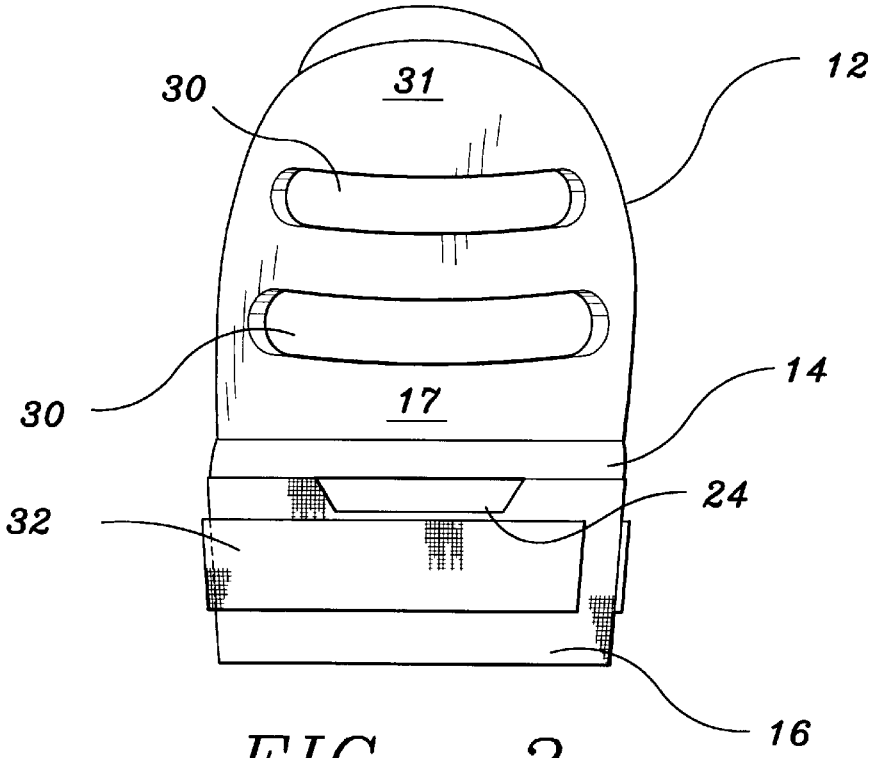
FIG. 3 is an elevational view of the back side of the present invention, i.e., the side which rests adjacent the pad of the thumb.

FIG. 3 shows that the first side 17 of the sheath 12 has two curvilinear slots 30 substantially parallel to one another and disposed in a direction substantially lateral relative to the sheath 12. The arcs defined by these slots curve slightly toward the closed end 31 of the sheath covering the tip of the thumb. When a user wears the sheath 12 on his or her thumb, these slots 30 expose an area of the thumbpad commonly used to manipulate and grip nails during setting and driving. By exposing this part of the thumbpad, the slots 30 provide a cavity suitably dimensioned to enable use of the thumb to roll nails into position between thumb and forefinger from a previous location in the palm of the same hand.

The slots 30 are slightly wider than the thickness of a sixteen-penny framing nail. In the preferred embodiment the presence of two slots affords the wearer an increased measure of control over the process of rolling nails, but it is of course possible to accomplish the same basic end through the inclusion of only one such slot. The presence of the slots 30 confers the further advantage of allowing the thumb to breathe, thereby protecting it against the discomfort of overheat, sweat, and odor. As shown in FIGS. 1 and 2, the second side 18 of the sheath 12 may be further defined by small apertures 40 to allow the area of the thumb surrounding the nail to breathe.

In its commercial embodiment, the present invention will be made available in a variety of sizes to accommodate thumbs of different sizes. Moreover, the symmetry of the human thumb allows the present invention to fit interchangeably on either a right or left thumb.

It is to be understood that the present invention is not limited to the embodiments described above, but encompasses any and all embodiments within the scope of the following claims.

I claim:

1. A protective device for shielding a thumb from errant hammer blows during the setting and hammering of nails, said device comprising:

a rigid sheath contoured to cover and protect the first phalanx of a human thumb, said rigid sheath having a first side for covering a thumbpad and a second side for covering a thumbnail, said rigid sheath having a closed end and an open end for inserting the thumb therein;

a flanged section integrally attached to said rigid sheath at the open end and extending therefrom;

a fastening jacket circumferentially affixed to said flanged section, said jacket being contoured to cover the second phalanx of a thumb, said jacket defining a semi-circular recess at the open end proximate the second side of said sheath, said jacket further defining a slotted aperture adjacent said flanged section proximate the first side of said sheath; and a band having first and second ends, said band transversely encircling said jacket, and further including means whereby said first and second ends are removably connected.

2. The protective device cited in claim 1, said device further including an extrusion on said second side extending slightly beyond said closed end, and having the shape of a slightly elongated thumbnail.

3. The protective device cited in claim 1, said device further. including at least one slot on said first side, said at least one slot being disposed transversely to the direction of the thumb.

4. The protective device cited in claim 3, wherein said at least one slot is arced outward slightly toward said closed end in said rigid sheath.

5. The protective device cited in claim 1, wherein said second side of said rigid sheath further includes a plurality of apertures.

6. The protective device cited in claim 1, wherein said flanged section has an inner surface, and wherein said fastening jacket is circumferentially hot-glued to said inner surface.

7. The protective device cited in claim 1, wherein said flanged section overlaps said rigid sheath at said open end so as to define an annular gap therebetween, said gap being oriented toward said open end, wherein said fastening jacket is circumferentially inserted into said gap and cinched into place.

* * * * *